US006048113A

United States Patent [19]

Van den Bergen et al.

[11] Patent Number: 6,048,113

[45] Date of Patent: Apr. 11, 2000

[54] PHOTOGRAPHIC SHEET MATERIAL PROCESSING

[75] Inventors: Patrick Van den Bergen, Hove; Ronny Van Bouwel, Ranst, both of Belgium

[73] Assignee: Agfa-Gevaert, Mortsel, Belgium

[21] Appl. No.: 09/142,344

[22] PCT Filed: Feb. 21, 1997

[86] PCT No.: PCT/EP97/00867

§ 371 Date: Sep. 4, 1998

§ 102(e) Date: Sep. 4, 1998

[87] PCT Pub. No.: WO97/33195

PCT Pub. Date: Sep. 12, 1997

[30] Foreign Application Priority Data

Mar. 7, 1996 [EP] European Pat. Off. ..... 96200630

[51] Int. Cl.[7] ..... G03D 3/06

[52] U.S. Cl. ..... 396/641; 222/318; 222/464.1

[58] Field of Search ..... 396/626, 630, 396/641, 624; 222/318, 464.1, 92, 135

[56] References Cited

U.S. PATENT DOCUMENTS 4,533,225 8/1985 Shiga ..... 396/626

5,148,208 9/1992 Klosterboer et al. ..... 354/324

5,543,884 8/1996 Earle et al. ..... 396/626

FOREIGN PATENT DOCUMENTS 0181967 of 0000 European Pat. Off. .

87118580 of 0000 Germany .

*Primary Examiner*—Alan A. Matthews

*Attorney, Agent, or Firm*—Baker Botts L.L.P.

[57] ABSTRACT

Photographic sheet material is processed using a processing cell through which the sheet material passes. Process liquid is fed from a collapsible storage container to the cell and returned from the cell to the container. The returning liquid is caused to enter the container as a jet stream. A cap assembly for the container comprises a body releasably connected to an upwardly facing mouth of the container. Inlet and outlet passages pass through the body and the inlet passage opening into the container is provided with a cross-sectional area smaller than that of the outlet passage to enable the jet stream to be achieved. Mixing of the returning process liquid in the container in a simple and economical manner is possible without compromising the ability of the container to collapse.

11 Claims, 4 Drawing Sheets

PHOTOGRAPHIC SHEET MATERIAL PROCESSING

FIELD OF THE INVENTION

This invention relates to a method of processing photographic sheet material and in particular to a storage container cap assembly for releasably connecting to the mouth of a collapsible storage container filled with process liquid, for use in association with an apparatus for the processing of photographic sheet material.

BACKGROUND OF INVENTION

Photographic processing apparatus will typically comprise a developing section, a fixing section, a wash section and a dryer. The process liquids for the developing section and the fixer section are typically provided in containers which can be in the form of rigid moulded polyethylene containers, or collapsible containers consisting of a collapsible plastic cube insert within a corrugated board outer support.

After a process liquid has been used, but it is not yet fully exhausted, it is desirable to store the liquid for later further use. Thus when the apparatus is not in use, for example over-night, the process liquid is returned to its container. There is therefore a need for a cap assembly for the container which enables both the removal of liquid therefrom and the return of liquid thereto. Furthermore, a processing apparatus may operate according to a regime where process liquid is constantly recirculated through a processing cell, the recirculation loop including the container. Such a regime also demands the use of a cap assembly for the container which enables both the removal and return of liquid.

A storage container cap assembly is known comprising a body, means carried on said body for releasably connecting the cap assembly to an upwardly facing mouth of a collapsible storage container filled with process liquid, an outlet passage passing through the cap body to enable process liquid to be withdrawn from the storage container, and a downwardly directed inlet passage passing through the cap body to enable process liquid to be returned to the storage container.

Such a cap assembly has the disadvantage that process liquid returning to the container tends to collect at the top of the container, i.e. is it is not well mixed with the remainder of the process liquid in the container. Consequently, the process liquid which is returned to the processing apparatus tends to be chemically more depleted than the average process liquid in the container. This phenomena is more noticeable if the temperature of the process liquid increases in the processing apparatus. Warm returning process liquid tends to settle on top of the cooler liquid remaining in the container.

It is desirable that the container filled with process liquid is a collapsible container, that is its volume decreases as process liquid is withdrawn therefrom. The use of such containers has the advantage that air space within the container is maintained at a minimum level, thereby reducing evaporation, oxidation or other contamination of the liquid. The use of such collapsible containers however prevents the use of a cap assembly in which the inlet passage is extended so as to open adjacent the bottom of the container.

OBJECTS OF INVENTION

It is an object of the present invention to ensure mixing of the returning process liquid in the container in a simple and economical manner, without compromising the ability of the container to collapse.

SUMMARY OF THE INVENTION

We have now discovered that this, and other useful objectives may be achieved when the process liquid enters the container as a jet stream.

Thus according to one aspect of the invention, there is provided method of processing photographic sheet material using an apparatus including a processing cell through which the sheet material passes, the method including feeding process liquid from a collapsible storage container to the cell and returning used process liquid from the cell to the collapsible storage container, the storage container being provided with a cap assembly comprising a body, means carried on the body releasably connecting the cap assembly to an upwardly facing mouth of the collapsible storage container, an outlet passage passing through the body to enable process liquid to be withdrawn from the storage container, and a downwardly directed inlet passage passing through the body to enable used process liquid to be returned to the storage container, characterised in that the returning used process liquid is caused to enter the collapsible storage container as a jet stream.

In one embodiment of the invention, the jet stream may simply be achieved by pumping the process liquid into the container at such a velocity as to generate a jet stream. It will not usually be necessary to pump process liquid from the container into the processing cell at the same velocity, and indeed such high pumping velocities may cause undesirable level fluctuations in the processing cell. Therefore the two pumps may be of different specifications, and may even be of a different type. For example we have found that a bellows pump is suitable for pumping process liquid from the container into the processing cell, while a peristaltic pump is used to pump the returning process liquid into the container.

In another embodiment of the invention, the jet stream is obtained by a particular design of the assembly, wherein the inlet passage opens into the container with a cross-sectional area smaller than that of the outlet passage.

Thus, according to a second aspect of the invention, there is provided a storage container cap assembly comprising a body, means carried on the body for releasably connecting the cap assembly to an upwardly facing mouth of a collapsible storage container, a outlet passage passing through the body to enable process liquid to be withdrawn from the storage container, and a downwardly directed inlet passage passing through the body to enable process liquid to be returned to the storage container, characterized in that the inlet passage opens into the container with a cross-sectional area smaller than that of the outlet passage.

The use of an inlet passage having an opening cross-section smaller than that of the outlet passage, enables the returning liquid to be pumped into the container at a linear speed higher than the linear speed with which the liquid is withdrawn from the container. Such a speed difference sets up turbulence within the liquid in the container and indeed it is possible to pump the returning liquid into the container a jet velocities, adding further to the turbulence within the liquid. This turbulence results in improved mixing of the liquid in the container, with the result that liquid withdrawn from the container is more representative of the bulk.

The cap assembly according to the invention may be in the form of a push-in/pull-out cap assembly, wherein the means for releasably connecting the cap assembly to the mouth of the collapsible storage container comprises a radially expandable and contractible resilient sealing member engagable with the mouth of the container. Preferably the resilient sealing member is expanded to engage inner surfaces within the mouth of the container by axial compression of the sealing member. The sealing member may be expanded and contracted through operation of a handle mounted on the cap body and having a cam surface thereon.

The inlet passage preferably opens into the container with a cross-sectional area as small as possible, but in any event at least 7 $mm^2$. That is, if the inlet cross-section is circular, a diameter of at least about 3 mm should be used. We have found that smaller diameter inlet passages are prone to clogging by debris carried in the process liquid. We have found that these dimensions are suitable when the process liquid is pumped into the container at an average rate of from 0.1 to 1.0 l/minute, such as about 0.3 l/minute and out of the container at an average rate of from 0.1 to 1.0 l/minute, such as about 0.9 l/minute.

The opening of the inlet passage into the container is preferably positioned below the opening of the outlet passage into the container, that is in practice below the surface of liquid in the container. This construction reduces the risk of the liquid taking a "short cut" from inlet to outlet and further ensures that the processing liquid enters directly into the bulk of the liquid in the container thereby reducing the entrainment of air into the liquid which would occur if the inlet were placed above the surface of the liquid in the container. Furthermore, if the inlet were to be positioned too high, there is a risk that the flow of liquid therefrom could be obstructed by the walls of the container.

The cap assembly may be connected to an outlet conduit leading from the outlet passage, and an inlet conduit leading to the inlet passage. These conduits enable the cap assembly to be connected to the processing apparatus. An outlet pump may be provided for pumping process liquid from the container along the outlet conduit. Similarly, an inlet pump may be provided for pumping process liquid along the inlet conduit to the container. The inlet and outlet pumps may be carried on the cap assembly.

The cap assembly is preferably provided with a fail-safe mechanism to prevent operation of the pumps when the cap assembly is not properly coupled to a container. The sealing member may be operated by an first handle which is movable between a sealed position and an unsealed position. Such a fail-safe mechanism ray include a valve, which in one position closes off the inlet and outlet passages of the cap assembly.

A movable second handle may be provided to operate the valve, the second handle being movable between a valve-open position and a valve-closed position. In the valve-open position the second handle acts as a stop to prevent operation of the first handle, while when the second handle is in the valve-closed position, the first handle is freely movable. The second handle may trigger a sensing device when in the valve-open position to enable operation of the pumps. With such a construction, the cap assembly can only be released from a container by first moving the second handle into the valve-closed position, thereby disabling the pumps and closing the valve, and thereafter moving the first handle into the unsealed position to contract the sealing member enabling withdrawal of the cap assembly from the container. As the sensing member, a micro-switch can be used, but an inductive sensor is preferred because of the humid and corrosive environment.

The cap assembly may be associated with an apparatus for the processing of photographic sheet material, the apparatus including a processing cell, a cell inlet connected to the outlet passage of the cap assembly for feeding process liquid from the container into the cell and a cell outlet connected to the inlet passage of the cap assembly for returning process liquid from the cell to the container.

In use, the cap assembly is connected to a collapsible container filled with process liquid, the container preferably being so constructed that its internal volume reduces as process liquid is removed therefrom.

DETAILED DESCRIPTION OF THE INVENTION

The invention will be described by the following illustrative embodiments with reference to the accompanying drawings without the intention to limit the invention thereto, and in which.

Figure 1:
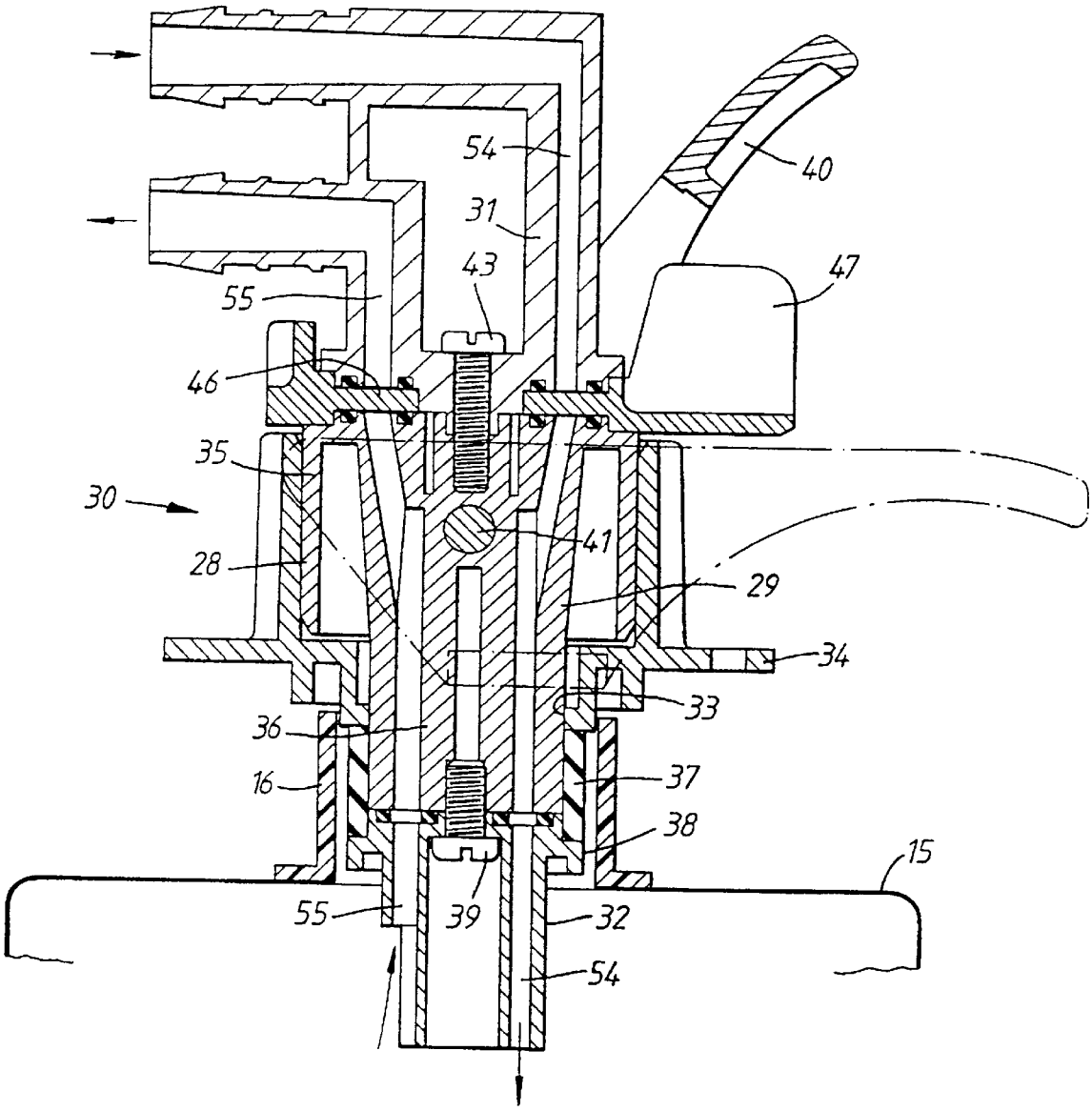
FIG. 1 is a vertical section through a cap assembly according to the invention in the pushed-in condition whilst being disengaged.

As shown in the Figures, a cap assembly 30 is releasably connected to a collapsible container 15 filled with process liquid. The container 15 is so constructed that its internal volume reduces as process liquid is removed therefrom.

The cap is in the form of a push-in/pull-out cap assembly 30 comprising a body 28 having a central portion 29, a head portion 31 and a tail portion 32. The cap body 28 is shown located in an aperture 33 of a support plate 34. A coupling device is carried on the body 28 for releasably connecting the cap assembly 30 to an upwardly facing mouth 16 of a collapsible storage container 15 filled with process liquid. Containers known as cubitainers which consist of a collapsible plastic cube inside a corrugated board outer are suitable. The body 28 has a large diameter upper portion 35 and a smaller diameter lower portion 36 which extends axially through the aperture 33. A radially expandable and contractible resilient sealing member in the form of a sealing ring 37 is engagable with the mouth 16 of the container 15 to provide a hermetic seal. The resilient sealing ring 37 is expanded to engage inner surfaces within the mouth of the container 15 by axial compression of the sealing ring 37. The annular elastomeric sealing ring 37 is fitted around the lower portion 36 extending beyond the support plate 34 and is held in place between the support plate 34 and an annular shoulder 38 formed on the tail portico 32, which is secured to the central body portion 29 by means of a screw 39.

Figure 2:
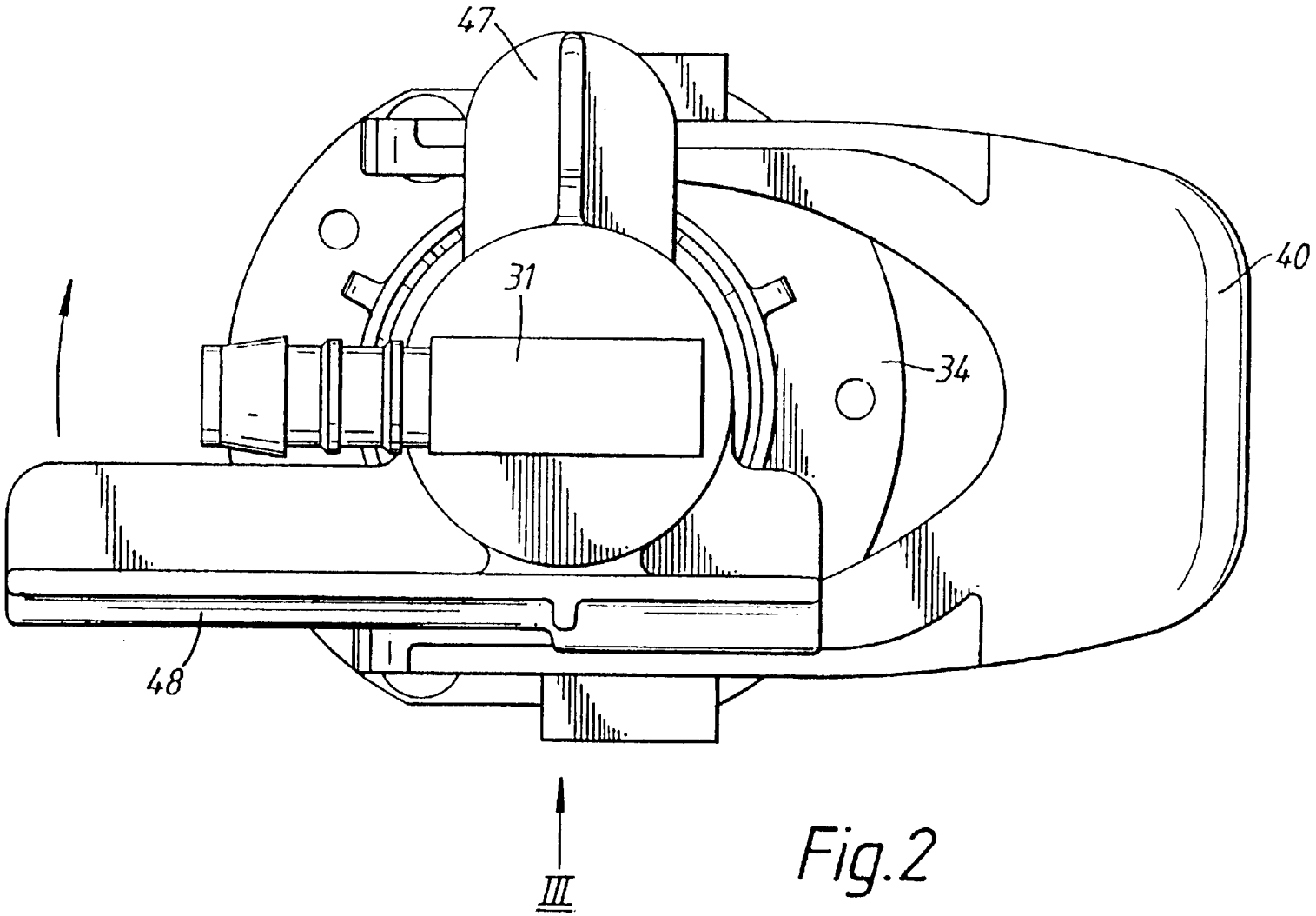
FIG. 2 is a view of the cap assembly shown in FIG. 1 from above, in the engaged position.
Figure 3:
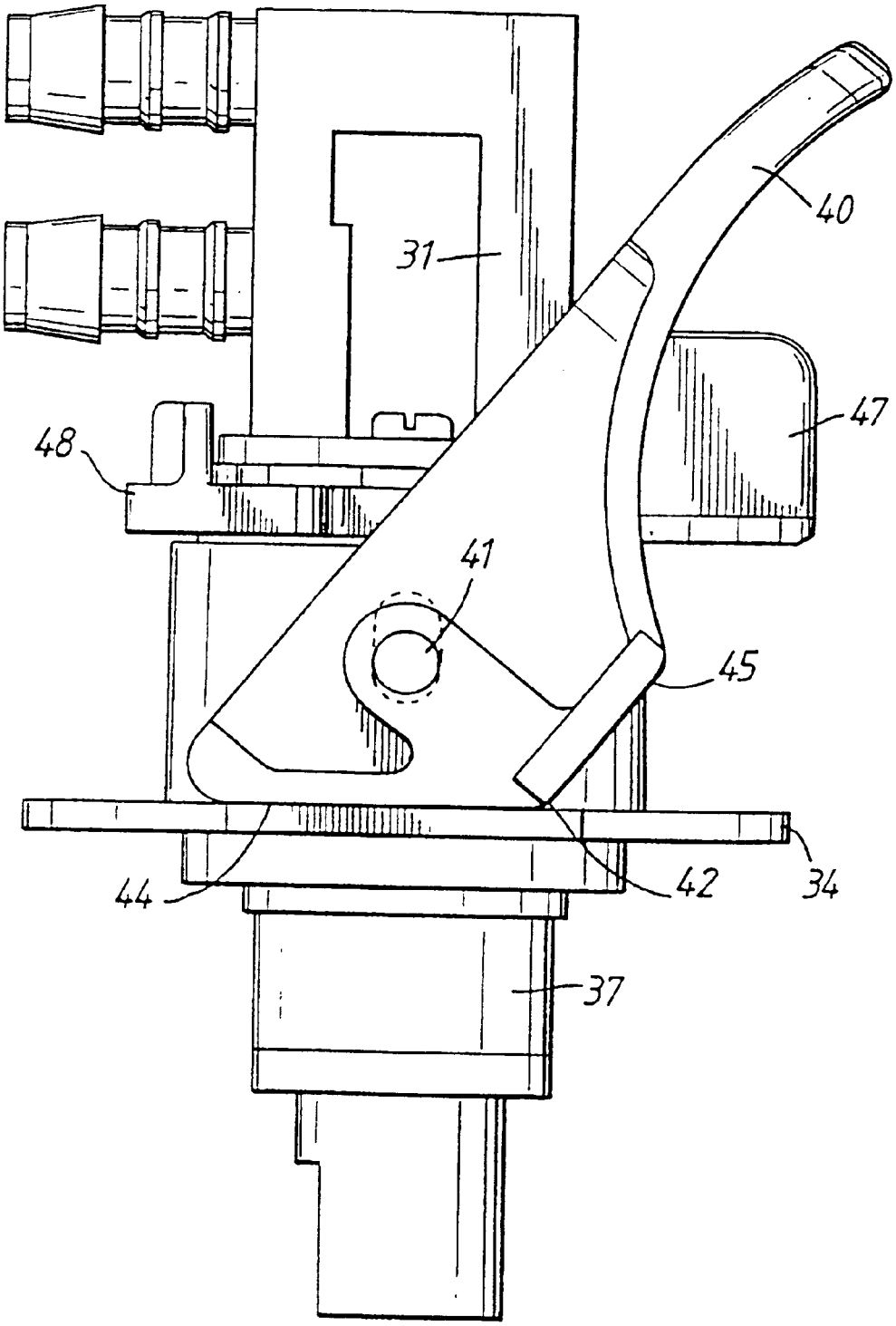
FIG. 3 is view taken in the direction III in FIG. 2, in the disengaged position.

The sealing ring 37 is expanded and contracted through operation of a first handle 40 mounted on the cap body 28. The first handle 40 is pivotally mounted to the central portion 29 of the body 28 by a pin 41, which passes through a slot in the upstanding portion of the support plate 34. As seen in FIG. 3, the first handle 40 has a cam surface portion 42 in contact with the support state 34 so that as the first handle 40 is pivoted about the pin 41 form the upper position shown in FIGS. 1 and 3 to the lower position shown by broken lines in FIG. 1 and as shown in FIG. 2, the cam surface 42 acts against the support plate 34 to relatively displace the body 28 upwardly. The two flat surface portions 44, 45 on either side of the cam surface 42 provide a 'lock out' facility with the first handle 40 in the upper and lower positions respectively.

As the first handle 40 displaces the cap body 28 upwardly relative to the support plate 34, the sealing ring 37 is compressed axially between the shoulder 38 and the support plate 34 causing the sealing ring to expand radially outwardly and engage the inner surfaces of the mouth 16 to hermetically seal the cap to the container and retain the cap in position.

An outlet passage 55 passes through the body 28 to enable process liquid to be withdrawn from the storage container 15. An inlet passage 54 passes through the body 28 to enable process liquid to be returned to the storage container 15. The passages 54 and 55 also pass through the tail portion 32. The opening of the inlet passage 54 into the container 15 is at a lower level than the opening of the outlet passage 55 into the container 15, by for example about 10 mm.

The inlet passage 54 has a diameter of 3 mm and opens into the container 15 with a cross-sectional area of 7 $mm^2$. The outlet passage 55 has a diameter, for example, of 5 mm and opens into the container 15 with a cross-sectional area of 21 $mm^2$, we have found that these dimensions are suitable when the process liquid is pumped into the container 15 at a rate of 0.3 l/minute and out of the container 15 at a rate of 0.9 l/minute.

The use of an inlet passage 54 having an opening cross-section smaller than that of the outlet passage 55, enables the returning liquid to be pumped into the container 15 at a linear speed higher than the linear speed with which it was withdrawn from the container 15, such a speed difference sets up turbulence within the liquid in the container 15 and indeed it is possible to pump the returning liquid into the container 15 at jet velocities, adding further to the turbulence within the liquid. This turbulence results in improved mixing of the liquid in the container 15, with the result that liquid withdrawn from the container 15 is more representative of the bulk.

The head portion 31 of the cap body 28 is secured to the central portion 29 by means of a screw 43 and comprises extensions of the inlet and outlet passages 54, 55.

Slidably located between the head portion 31 and the central body portion 29 is a disk-shaped valve member 46. The valve member 46 can be rotated about the axis of the body member by means of a second handle 48, between a position as shown in FIG. 1 where the inlet and outlet passages 54, 55 are closed, and a position where holes (not shown) in the valve member 46 are aligned with the passages 54, 55, thereby opening the valve. The valve member 46 also carries a radially extending tongue 47 (see FIG. 2) which, in the valve open position shown in FIG. 3, acts as a stop to prevent the first handle 40 being raised and thereby preventing the cap assembly being removed from the container.

Figure 4:
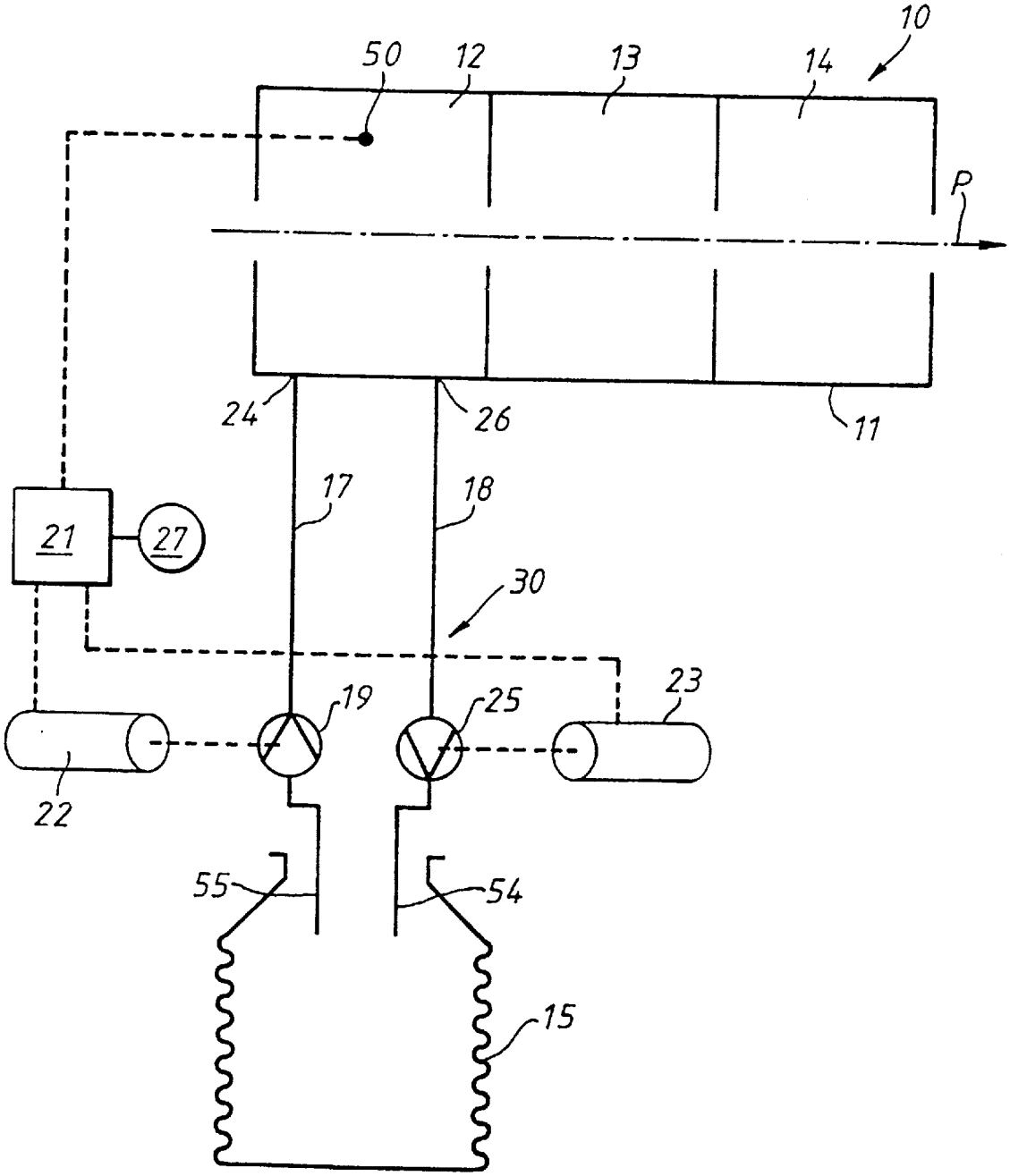
FIG. 4 is a schematic drawing of a photographic processing apparatus incorporating the cap assembly according to the invention.

FIG. 4 illustrates in schematic form a process apparatus 10 for processing photographic material and in particular for producing off-press colour proofs for accessing the quality of colour separations and colour rendition in printing.

The photographic proof will in the course of its development pass through a liquid developer which develops the silver image, a liquid bleach fixer which removes silver from the proof, a wash to remove non hardened parts and a drier. A proof will have to make at least four such passes to build up a full colour picture.

An outlet conduit 17 leads from the outlet passage 55 of the cap assembly 30, and an inlet conduit 18 leads to the inlet passage 54. These conduits connect the cap assembly 30 to a processing apparatus 10.

An outlet pump 19 is provided for pumping process liquid from the container 15 along the outlet conduit 17. Similarly, an inlet pump 25 is provided for pumping process liquid along the inlet conduit 18 to the container 15. The inlet and outlet pumps 19, 25 can be carried on the cap body 28, on the support plate 34 or may be separately mounted.

An inductive switch (not shown) may be provided, to be actuated by the second handle 48 in the valve-open position, to enable operation of the inlet and outlet pumps 19, 25.

The processing apparatus 10 has a housing 11 which encloses a development cell 12, a bleach-fixing cell 13 and a washing cell 14. The apparatus is provided with suitable sealing devices at the entrance and exit thereof, and between adjacent cells, in a known manner. Photographic sheet material to be processed is transported through the apparatus along a sheet material path P. The development cell, in particular, is as enclosed as possible to prevent oxidation of the liquid developer in the cell 12.

As shown, the process liquid for the development cell 12 is supplied in the collapsible container 15. Process liquids for use in other cells of the apparatus may be supplied in a similar manner. A cell inlet 24 is connected to the outlet passage 55 of the cap assembly 30 via the conduit 17 for feeding process liquid from the container 15 into the cell. The process liquid is delivered to the cell 12 through the supply conduit 17 by means of the delivery pump 19. The delivery pump 19 has a motor 22 connected to a controller 21 which controls the operation of the pump.

A liquid level sensor 50 monitors the presence of liquid in the cell 12 and is connected to the controller 21 to cause the respective delivery pump 19 to supply the respective process liquid to the cell until the liquid level therein has reached a predetermined minimum level. This will automatically compensate for loss of process liquid caused by evaporation and carry over.

A cell outlet 26 is connected to the inlet passage 54 of the cap assembly 30 via conduit 18 for returning process liquid from the cell to the container 15. The exit pump 25, powered by a motor 23, is located in the return conduit is of the cell 12. The exit pump 25 is preferably a peristaltic type pump which gives a good shut off when the pump is inoperative, while the outlet pump 19 is preferably a bellows pump, having a higher flow rate than the inlet pump 25. The controller 21 causes the exit pump 25 to operate for a predetermined time period after predetermined time intervals so that used liquid from the cell 12 is regularly removed and returned to the container 15. This removes process liquid which may degenerate due to both oxidation and use. The time interval between operations of the exit pump, and/or the time period for which the pump is operational may be controlled by a timer control 27. However, said time intervals may also be based on the throughput (i.e. $m^2$) of the processed material.

What is claimed is:

1. A method of processing photographic sheet material using an apparatus including a processing cell through which said sheet material passes, the method including feeding process liquid from a collapsible storage container to said cell and returning used process liquid from said cell to said collapsible storage container, said storage container being provided with a cap assembly comprising a body, means carried on said body releasably connecting the cap assembly to an upwardly facing mouth of said collapsible storage container, an outlet passage passing through said body to enable process liquid to be withdrawn from said storage container, and a downwardly directed inlet passage passing through said body to enable used process liquid to be returned to said storage container, characterised in that said returning used process liquid is caused to enter said collapsible storage container as a jet stream.

2. A method according to claim 1, wherein said jet stream is achieved by pumping said used returning process liquid into said storage container at such a velocity as to generate said jet stream.

3. A method according to claim 2, wherein said process liquid is fed from said storage container to said processing cell at a lower velocity.

4. A storage container cap assembly comprising a body, means carried in said body for releasably connecting the cap assembly to an upwardly facing mouth of a collapsable storage container, an outlet passage passing through said body to enable process liquid to be withdrawn from said storage container, and a downwardly directed inlet passage passing through said body to enable used process liquid to be returned to said storage container, wherein said inlet passage opens into said container with a cross-sectional area smaller than that of said outlet passage, and wherein the cap assembly is in the form of a push-in/pull out cap assembly, wherein said means for releasably connecting the cap assembly to the mouth of a collapsable storage container comprises a radially expandable and contractible resilient sealing member engagable with the mouth of said connector.

5. A cap assembly according to claim 4, wherein said inlet passage opens into said container with a cross-sectional area of at least 7 $mm^2$.

6. A cap assembly according to claim 4, wherein the opening of said inlet passage into said container is positioned lower than the opening of said outlet passage into said container.

7. A cap assembly according to claim 4, connected to an outlet conduit leading from said outlet passage, and an inlet conduit leading to said inlet passage.

8. A cap assembly according to claim 7, further comprising a outlet pump for pumping process liquid from said container along said outlet conduit and an inlet pump for pumping process liquid along said inlet conduit to said container.

9. A cap assembly according to claim 8, provided with a fail-safe mechanism to prevent operation of said outlet pump and said inlet pump when the cap assembly is not properly coupled to a container.

10. A cap assembly according to claim 4, associated with an apparatus for the processing of photographic sheet material, said apparatus including a processing cell, a cell inlet connected to said outlet passage of said cap assembly for feeding process liquid from said container into said cell and a cell outlet connected to said inlet passage for returning used process liquid from cell to said container.

11. A cap assembly according to claim 4, connected to a collapsible container filled with process liquid, said container being so constructed that its internal volume reduces as process liquid is removed therefrom.

* * * * *